US008031166B2

(12) United States Patent
Qiao et al.

(10) Patent No.: US 8,031,166 B2
(45) Date of Patent: Oct. 4, 2011

(54) LIQUID CRYSTAL DISPLAY METHOD AND THE APPRATUS THEREOF

(75) Inventors: Mingsheng Qiao, Shan Dong (CN); Weidong Liu, Shan Dong (CN); Xingfeng Chen, Qingdao (CN); Guopeng Huang, Qingdao (CN)

(73) Assignees: Hisense Beijing Electric Co., Ltd., Beijing (CN); Hisense Group Co., Ltd., Qingdao (CN); Hisense Electric Co., Ltd., Qingdao (CN)

( * ) Notice: Subject to any disclaimer, the term of this patent is extended or adjusted under 35 U.S.C. 154(b) by 1001 days.

(21) Appl. No.: 11/935,857

(22) Filed: Nov. 6, 2007

(65) Prior Publication Data

US 2009/0115718 A1 May 7, 2009

(51) Int. Cl.
*G09G 3/36* (2006.01)

(52) U.S. Cl. ..... 345/102; 345/87; 345/89

(58) Field of Classification Search ..... 345/87–100, 345/102

See application file for complete search history.

(56) References Cited

U.S. PATENT DOCUMENTS

| | | | | |
|---|---|---|---|---|
| 6,452,582 | B1 * | 9/2002 | Rolston | 345/102 |
| 6,762,742 | B2 * | 7/2004 | Moon et al. | 345/102 |
| 7,113,164 | B1 | 9/2006 | Osorio | |
| 7,397,457 | B2 * | 7/2008 | Sugino et al. | 345/89 |
| 7,460,103 | B2 * | 12/2008 | Konno et al. | 345/102 |
| 7,881,549 | B2 * | 2/2011 | Yamashita et al. | 382/254 |
| 2004/0163495 | A1 * | 8/2004 | Konen | 81/9.4 |
| 2004/0257329 | A1 * | 12/2004 | Park et al. | 345/102 |
| 2005/0231458 | A1 * | 10/2005 | Miki | 345/102 |
| 2006/0125771 | A1 * | 6/2006 | Inuzuka et al. | 345/102 |
| 2006/0125773 | A1 * | 6/2006 | Ichikawa et al. | 345/102 |
| 2006/0164379 | A1 * | 7/2006 | Oh et al. | 345/102 |
| 2007/0064020 | A1 * | 3/2007 | Credelle et al. | 345/694 |
| 2007/0120766 | A1 | 5/2007 | Yanamoto | |
| 2007/0126636 | A1 * | 6/2007 | Zhang et al. | 342/461 |
| 2007/0279574 | A1 * | 12/2007 | Minamizaki et al. | 349/192 |
| 2008/0238856 | A1 * | 10/2008 | Bhowmik et al. | 345/102 |
| 2008/0252589 | A1 * | 10/2008 | Chung et al. | 345/102 |

FOREIGN PATENT DOCUMENTS

JP 2002-099250 A 4/2002

OTHER PUBLICATIONS

Search Report dated Feb. 25, 2008 in corresponding EP Application No. 07 02 1495—5 pages.

* cited by examiner

*Primary Examiner* — Kimnhung Nguyen

(74) *Attorney, Agent, or Firm* — Knobbe Martens Olson & Bear LLP

(57) ABSTRACT

The present invention discloses a liquid crystal display method, which can adjust the brightness of different segments of backlight according to the different images. Especially, the present invention discloses a liquid crystal display method, which includes: receiving a image signal; analyzing the image signal; dividing the image into at least two image segments according to the analysis result of the image signal; dividing the backlight into at least two backlight segments according to the division result of the image; adjusting the brightness of the backlight in each backlight segment; adjusting the image signal in each image segment. The liquid crystal display method of the present invention divide the image and the backlight according to the image signal, while adjusting the brightness of the image and backlight in each segment to not only decrease the power consumption of the liquid crystal display, but also increase the contrast of the image signal, thereby improving the effect of liquid crystal display.

17 Claims, 4 Drawing Sheets

(a)

(b)

LIQUID CRYSTAL DISPLAY METHOD AND THE APPRATUS THEREOF

BACKGROUND OF THE INVENTION

1. Field of the Invention

The present invention relates to a display method and the corresponding display apparatuses, especially to a liquid crystal display method and the corresponding liquid crystal display apparatuses.

2. Description of the Related Art

The liquid crystal display (LCD) of a liquid crystal display device (such as liquid crystal television) can not radiate by itself, however it belongs to backlight display device. There is backlight in the back of the LCD, and the LCD device displays or recovers the image by the fine particles, which is uniformly arranged in the screen, "interdicting" and "turning on" the light emitted by the backlight. In the preliminary stage, the backlight works as long as the LCD is switched on, even if the displayed image is completely black. That is, the backlight of a LCD television radiates all the time. Since transmittance of liquid crystal is very low, the lightness of the backlight should be strong enough to make the lightness of liquid crystal TV high enough to perfectly display the image, which not only shorten the lifetime of the backlight of the LCD device, but also easily cause asthenopia of the watcher; Yet the contrast and color saturation of the displayed image will be decreased if the lightness of the backlight decreases.

U.S. prior application U.S. Pat. No. 7,113,164 disclosed a technology scheme for adjusting the lightness of the LED backlight area. Although this technology scheme solves the problem of contrast and saturation of LCD to some extent, but it also has some deficiencies: since the division of the backlight is fixed and don't change, only the lightness of the pixels in fixed segments can be adjusted, and adjustment can not be done according to changes in different displayed image, therefore it can not meet the display requirement of image which constantly changes.

SUMMARY OF THE INVENTION

In order to solve the problems existing in the prior art, the present invention provides a LCD method, which can adjust the backlight segments according to the difference of the displaying images to satisfy the display requirement of the image which constantly changes.

Especially, the present invention provides a liquid crystal display method, which includes:

receiving a image signal;

analyzing the image signal;

dividing the image into at least two image segments according to the analysis result of the image signal;

dividing the backlight into at least two backlight segments according to the division result of the image;

adjusting the brightness of each backlight segment;

adjusting the image signal in each image segment.

Furthermore, the present invention also provides a LCD apparatuses, which includes a image input interface, a image processing device, a liquid crystal display screen and a backlight;

said image processing device includes a image analysis unit, a division unit, a liquid crystal interface unit, a backlight driver and a CPU;

said image input interface receives image signal;

said image analysis unit analyzes the received image;

said division unit divides said image into at least two image segments according to the analysis result of the image analysis unit; meanwhile divides said backlight into at least two backlight segments according to the image division result;

said backlight driver adjusts the brightness in each backlight segment;

said liquid crystal interface unit adjusts the brightness of image signal in each segment and sends the adjusted image signal to the said LCD screen to display.

LCD method of the present invention divides the image and backlight according to the image signal, and adjusts the brightness of the divided image segment and backlight segment to not only decrease the power consumption of LCD, but also increase the contrast of the image signal, thereby improving the display effect of LCD.

DETAILED DESCRIPTION OF THE PREFERRED EMBODIMENTS

In order to make one skilled in the relevant art readily understand the present invention and make the objects, features and advantages of the present invention more apparent, the present invention will be described in further detail with reference to embodiments and the accompanying drawings.

Figure 1:
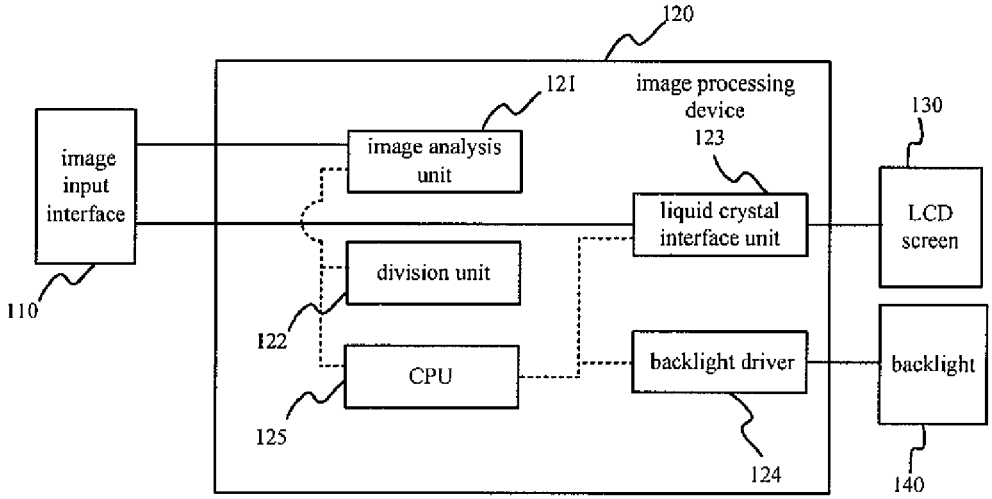
FIG. 1 is a schematic diagram in accordance with the first embodiment of the present invention.

As shown in FIG. 1, the LCD apparatuses according to the first embodiment of the present invention includes a image input interface 110, a image processing device 120, a LCD screen 130 and a backlight 140, and the image processing device 120 includes a image analysis unit 121, a division unit 122, a liquid crystal interface unit 123, a backlight driver 124 and a CPU 125. Wherein the image processing device 120 may consist of several separated components or they are integrated into a single chip to become one-body architecture. The LCD apparatuses can be LCD TV, LCD, palmtop computer or cell phone and so on.

The working process of the apparatuses is as follows:

The image input interface 110 receives image signal and sends it to the image processing device 120. Wherein, the image signal can be either a digital signal or an analog signal, such as RGB, CVSB or S-video signal. If it is an analog signal, it will firstly be A/D converted by the image input interface 110 to become a digital signal, and then be sent to the image processing device 120. Hereinafter RGB signal analysis will be described as an example of image processing device 120.

One channel of RGB signal received by the image processing device 120 will be sent to the image analysis unit 121 for analyzing. The analysis of image signal can be done in many ways; it can analyze the image signal directly in spatial domain or in frequency domain. For example, directly calculate the brightness of the image signal via methods such as Fourier transform, Laplace transform, etc., or analyze the spectrum of the image signal via other methods.

Hereinafter brightness analysis will be described as an example of working process of the image analysis unit 121.

Firstly, the image analysis unit 121 transforms the received a single frame of RGB signal to YUV formatted digital signal to extract the brightness signal in the RGB signal; therefore, this procedure can be replaced by extracting the brightness information of the RGB signal. YUV signal is usually used as image signal format wherein "Y" represents brightness, while "U" and "V" represent chroma, which describe the image color and saturation to indicate the color of the pixel. The brightness is constructed by RGB input signal by overlapping the specific part of the RGB. Chroma defines hue and saturation, which are represented respectively by Cr and Cb.

Figure 2:
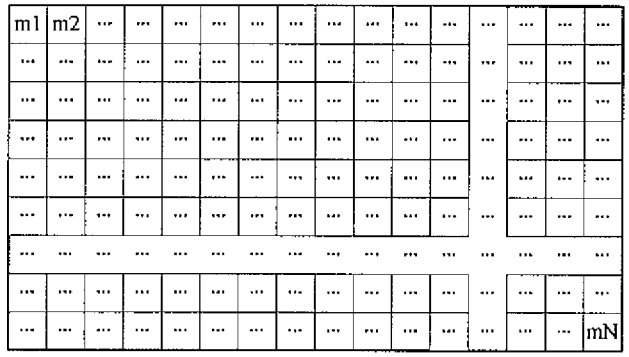
FIG. 2 is a schematic diagram of image process of image processing device in FIG. 1.
Figure 2:
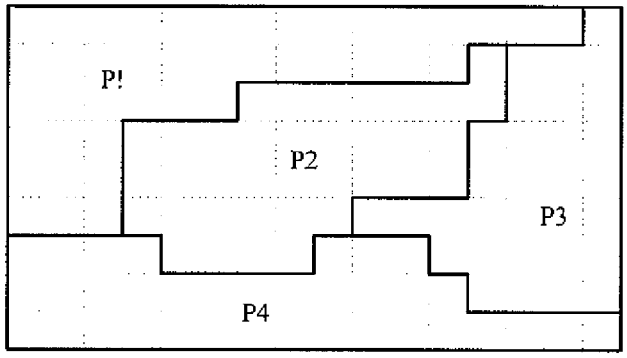

Then the image analysis unit 121 divides the whole image into several segments, wherein the segments can be rectangle, triangle, hexagon, rhomb, cross or other irregular graphics, and the shape and size of all segments can be the same or different. In order to be convenient for calculation, it is preferred that the image analysis unit 121 divides the image into M rectangle segments with the same size, wherein M is a natural number, whose value can be determined by the size of the image signal. Generally, the value of M is larger, the effect of the embodiment is better; when the rectangle segments are small enough until it becomes a pixel dot, the value of M is maximal, and the maximum value is the number of the pixels included in the whole image. For illustration, the individual rectangle segments are indicated as m1, m2, . . . , mM, as shown in FIG. 2(*a*).

Each divided rectangle segments includes several pixel dots of the image; each pixel has the corresponding YUV information. If the number of pixel dots included in each rectangle segment is A, then the number of Y-components included in each rectangle segment is A. By analyzing the Y-component included in each rectangle segment, the image analysis unit 121 can calculate or statistics the brightness information of each rectangle segment. For illustration, the brightness information of each rectangle segment is indicated as y1, y2, . . . , yM respectively. Herein the brightness information can be the maximal brightness, average brightness, the difference between the maximal brightness and the minimal brightness or other brightness information of each rectangle segment. The calculation and statistics of the brightness information can be performed in many ways, which will not be illustrated in detail here.

The image analysis unit 121 sends the brightness analysis result to the division unit 122, which will divides the image according to the analysis result including the brightness information of each rectangle segment. Herein the image dividing is actually a procedure of combination, namely combining several rectangle segments according to the brightness information of each rectangular segment, it includes that several rectangle segments, whose brightness information y1, y2, . . . , yM meet a certain condition are combined into a image segment according to a certain division rule; the rectangular segments which meet another condition are combined into another image segment, and the like. Until all rectangular segments are combined into their corresponding image segments. For illustration, the combined image segments are indicated as P1, P2, . . . , Px, wherein x is the number of segments, whose maximal value is M. Generally, x is larger, the effect of the embodiment is better, and the corresponding process will be more complex. If the number of segments is 4, then the divided image may be shown as FIG. 2(*b*), the divided image can be continuous or discontinuous.

There can be various division rules, which can be predetermined or dynamically determined according to the image signal. In contrast, the predetermined rule is more convenient for process, yet the dynamically determined rule can more clearly embody the feature of the present invention. In the following, these two rules will be illustrated respectively.

When the division unit 122 divides the image according to predetermined rule, supposing the predetermined rule is: dividing the image according to the maximal brightness, and the maximum brightness is divided into 4 grades of 0-63, 64-127, 128-191 and 192-255, each grade corresponds to an image segment. The working process of the division unit 122 is as follows: firstly the division unit 122 receives the brightness information of each rectangular segment. Then the division unit 122 compares the maximal brightness of each rectangular segment with the brightness grade in the division rule: that is, the rectangular segments, whose maximal brightness is in the range of 0-63, are combined into the first image segment which is indicated as P1; those rectangular segments, whose maximal brightness is in the range of 64-127, are combined into the second image segment, which is indicated as P2; the rectangular segments, whose maximal brightness is in the range of 128-191, are combined into the third image segment, which is indicated as P3; the rectangular segments, whose maximal brightness is in the range of 192-255, are combined into the fourth image segment, which is indicated as P4. Finally, the division unit 122 sends the relative information of P1, P2, P3 and P4 to CPU 125.

When the division unit 122 divides the image according to dynamical division rule, it is different from according to the predetermined division rule, the process according to the dynamic division rule includes a further step of determining division rule after the division unit 122 receives the brightness analysis result from the image analysis unit 121. In most cases, the difference between the process according to the dynamic division rule and the process according to the predetermined division rule is determining dividing threshold. For division according to the maximal brightness; in division rule of the previous example of predetermined division rule it uses three constant thresholds 63, 127 and 191 to divide the whole brightness area into 4 segments with the essential same size, while in dynamic division rule it will determine similar thresholds according to the image itself. Take dividing into 4 segments for example, one method is determining three thresholds by calculating the weighted average brightness of the brightness histogram, and the procedure includes as follows: calculating the brightness histogram of the image; calculating the weighted average brightness of the histogram and indicating it as Ya1; calculating the weighted average brightness of the image whose brightness is in the range of 0-Ya1 and indicating it as Ya2; calculating the weighted average brightness of the image whose brightness is in the range of Ya1-255 and indicating it as Ya3. Such three calculated weighted average brightness can be used to determine three thresholds for the dynamic division rule, and the division rule can be determined as: dividing according to the maximal brightness and the range of maximal brightness is divided into 4 grades as 0-Ya2, Ya2-Ya1, Ya1-Ya3 and Ya3-255. Each grade corresponds to an image segment. Then the division unit 122 compares the maximal brightness of each rectangular segment with the brightness grade in the division rule, and then the rectangular segments, whose maximal brightness is in the ranges of 0-Ya2, Ya2-Ya1, Ya1-Ya3 and Ya3-255, are respectively combined into four image segments.

Since histogram represents the statistics relationship between each brightness and its occurring probability, the size of the segments determined by calculating the weighted average brightness of the histogram will be close to each other. For example, For whole image whose picture is relatively dark, since the occurring probability of the low brightness is relatively high, for the segment divided according to the aforesaid predetermined rule, the number of the rectangular segments whose maximal brightness in the ranges of 0-63 and 64-127 will be relatively bigger, the corresponding area of P1 and P2 will be larger, while the number of rectangular segments, whose maximal brightness is in the ranges of 128-191 and 192-255 will be smaller, the corresponding area of P1 and P2 will relatively smaller. Yet the area of the four image segments divided according to the aforesaid dynamic division rule will be close to each other.

After the image is divided, the division unit 122 divides the backlight according to the image division result. For illustration, the divided backlight segments are indicated as B1, B2, . . . , Bx (x represents the number of the segments). Generally, the backlight segments correspond to the image segments, and the division methods of backlight and image are totally same. For example, the shape, size, and position of B1 and P1 are same. It should be noted that terms of division, dividing mentioned in the present invention should be understood as symbolically dividing of the image or backlight, while not as dividing in physics or circuit.

CPU 125 determines the brightness adjustment rule of each backlight segment according to the division result and sends the division result and the corresponding adjustment rule of each backlight segment to the liquid crystal interface unit 123 and the backlight driver 124. To easily perform this process, preferably, the CPU 125 of the present invention calculate the brightness normalized coefficient of each image segment according to the maximal brightness of each image segment to determine the adjustment rule of each backlight segment.

In the following, the working process of CPU 125 will be illustrated by taking the backlight segment B1 for example: the corresponding image segment of the backlight segment B1 is P1, suppose the maximal brightness of the image in the image segment P1 is Lp1, while the maximal brightness of the brightness signal is defined as Lmax, then Lp1 to Lmax ratio can be calculated to determine a numerical value, which can be used as the brightness normalized coefficient of the backlight segment B1. The coefficient is indicated as u1, that is u1=Lp1/Lmax. It can be seen that u1 is usually less than 1. In order to embody the effect of the present invention to the utmost extent, the value of Lmax is generally 255, and the calculation of brightness normalized coefficient is not limited into this calculation method. After the brightness normalized coefficient u1 of the backlight segment B1 is calculated out, CPU 125 calculates the brightness normalized coefficients of B2, B3, . . . , Bx and indicates them as u2, u3, . . . , ux. After that, CPU 125 sends the brightness normalized coefficient of each backlight segment to the backlight driver 124 and the liquid crystal interface unit 123.

The backlight driver 124 generates the driving signal of each backlight segment according to the brightness adjustment rule determined by CPU 125 for the backlight 140. The common backlight driver, which can not be adjusted according to the difference of the displaying picture, usually work with the maximal brightness, and the driving signal of each backlight from the corresponding backlight driver is the same. Differently the backlight driver 124 of the present invention can send different driving signals to different backlights according to different backlight segments.

In the following, the working process of the backlight driver 124 will be illustrated by taking the brightness adjustment rule determined by the aforesaid brightness normalized coefficient for example. It includes: after the backlight driver 124 receives the brightness normalized coefficient of each backlight segment, the driving signal of each backlight segment is adjusted according to the brightness normalized coefficient of each backlight segment.

Take the backlight segment B1 for example, After the backlight driver 124 receives the brightness normalized coefficient u1 of the backlight segment B1, it firstly determines the displaying brightness needed by the backlight segment B1 according to the brightness normalized coefficient u1, and the displaying brightness needed by B1 is indicated as Lb1. Suppose the brightness of the backlight in normal working condition is Lb, and the normal working current is ib. Then the backlight driver 124 determines Lb1 by multiplying Lb by u1, that is Lb1=Lb×u1. After the displaying brightness Lb1 needed by B1 is determined, the backlight driver 124 adjusts the corresponding driving signal. Since the brightness of the backlight is determined by the light flux of the backlight LED, as the LED light flux is linear with its working current, according to Lb1=Lb×u1, it can be easily seen that the corresponding working current of B1 should be ib×u1. If the backlight driver 124 uses PWM (pulse width modulation) signal to drive the backlight, the duty cycle of the corresponding PWM signal should be adjusted. Suppose the duty cycle of the corresponding PWM signal of iB is Db, then the backlight driver 124 adjusts the duty cycle of the driving signal of the backlight segment B1 to Db×u1. Then the backlight driver 124 adjust the driving signal of each segment B2, B3, . . . , Bx by the same method. Finally, the backlight driver 124 sends the adjusted driving signal of each segment to the backlight 140 to control the brightness of the backlight 140.

After the backlight 140 receives the adjusted driving signal, it transforms the driving signal into the corresponding driving current and sends it to the backlight LED of the corresponding backlight segment. Since the driving signals of the corresponding backlight segments are different, the brightness of each segment in the backlight 140 will be correspondingly different. Since the value of brightness normalized coefficient is usually less than 1 (the maximal value is 1), the brightness of the backlight in each segment will less than the brightness Lb when the backlight work in the normal condition. Therefore, the LCD device of the present invention can effectively decrease the power consumption of the backlight.

Since the brightness of the backlight is adjusted, in order to properly display the original image, the image signal itself must be correspondingly adjusted. The liquid crystal interface unit 123 adjusts the image signal itself according to brightness adjustment rule determined by the CPU 125 and the division result.

In the following, the working process of the liquid crystal interface unit 123 will be illustrated by still taking the brightness adjustment rule determined by the aforesaid brightness normalized coefficient for example. Take the image segment P1 for example, since the brightness of the corresponding backlight segment B1 of the image segment P1 is adjusted from the original Lb to Lb1, Lb1=Lb×u1, the brightness of B1 becomes u1 times of the original one, therefore the brightness of the image segment P1 needs to be divided by u1 to properly display the image of the segment. Based on this, the liquid crystal interface unit 123 adjusts the image brightness of P1, and dividing the brightness of all pixels in the image segment P by u1 to obtain new brightness information. Then, image brightness of other each image segments is similarly adjusted by the liquid crystal interface unit 123. Finally, the liquid crystal interface unit 123 transforms the adjusted image signal into the signal conforming to LCD screen interface specification and sends it to LCD screen 130 for displaying.

Besides adjusting the brightness of the image signal, the liquid crystal interface unit 123 can refer a configurable two-dimensional reference table to perform the chroma optimizing process for the image signal in each image segment. Generally, the values of the parameters in the aforesaid configurable two-dimensional reference table are experimental values obtained by a lot of subjective evaluating.

It can be seen from the calculation method of the aforesaid brightness normalized coefficient that, since u1=Lp1/Lmax, after dividing the brightness of the image segment P1 by u1, the maximal brightness changes from the original Lp1 to Lmax. Suppose the original maximal brightness of the image segment P1 is 50, Lmax is valued as 255, then the brightness range of the image segment P1 after adjustment changes from 0-50 to 0-255, and the contrast of the image signal is largely increased. It can solve the problem of low contrast and unclear level when the present LCD is in low brightness. Besides just mathematical operation of the brightness of the corresponding image, there are many other methods for adjusting the image signal in the image segment, such as the image enhancement algorithm of histogram equalization, to effectively increase the amount of information of the image to perfectly display the image signal.

It should be mentioned that sending the driving signal to the backlight 140 and sending the signal conforming to the LCD interface screen specification to the LCD screen 130 are performed synchronously. Each functional unit in the image processing device 120 is only defined according to its function for illustration. Actually, these units can be combined into a chip or a software program. The backlight 140 can also be a component of LCD screen 130.

Figure 3:
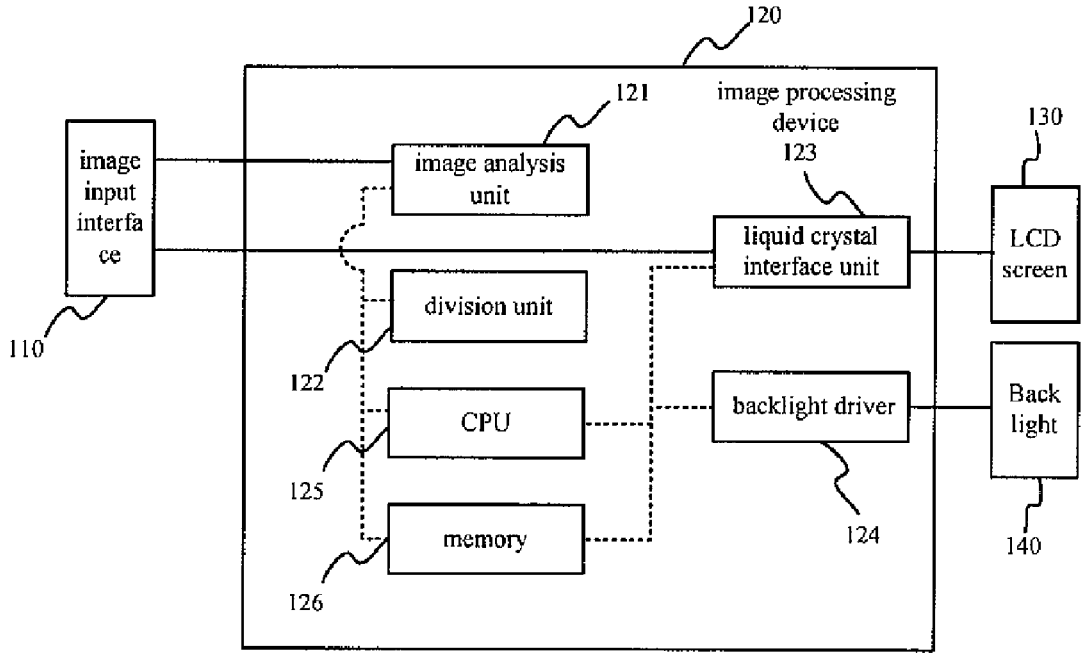
FIG. 3 is a schematic diagram in accordance with the second embodiment of the present invention.

FIG. 3 is a schematic diagram of the second embodiment of the present invention. It is different from FIG. 1 that the image processing device 120 of LCD apparatuses of the second embodiment still includes a memory 126. The memory 126 is used to store the data process result of each unit in the image processing device 120; therefore, each unit of the image processing device 120 can perform the corresponding process through calling the stored data in the memory 126.

Figure 4:
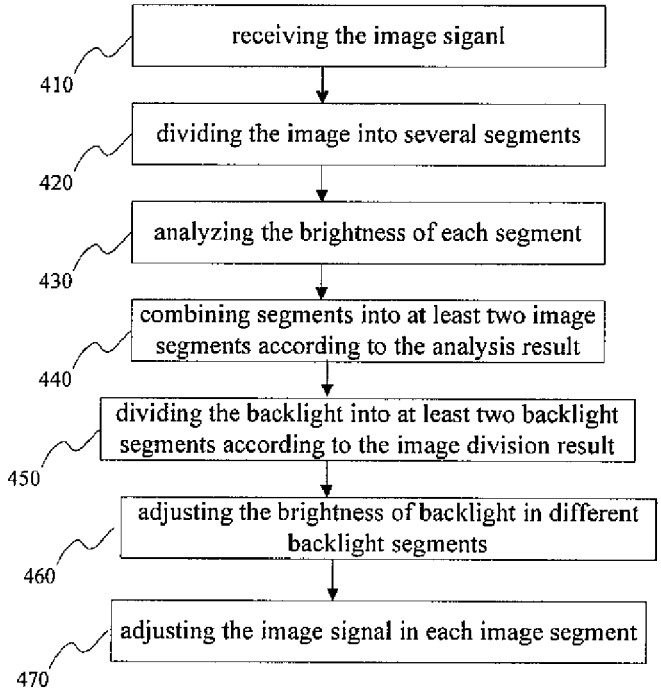
FIG. 4 is a schematic diagram in accordance with the third embodiment of the present invention.

As shown in FIG. 4, the schematic diagram of the third embodiment of the present invention is a schematic diagram of a LCD method.

Specifically, in step 410, receives the image signal; wherein the image signal can be either digital signal or analog signal. If it is a analog signal, it is subjected to A/D convert to become digital signal.

In step 420 divides the whole image into several segments, wherein the several segments can be several rectangle, other several kinds of shapes, or even combination of several kinds of graph. And the sizes of all segments can be same or different. Preferably, the present invention divides the image into rectangles with the same size.

In step 430, analyze the brightness of the image signal in each segment by various methods, such as calculating the average brightness of each segment, the difference of the maximum brightness and the minimum brightness of each segment, or the maximum brightness of each segment. Take calculating the average brightness of each segment for example, aforesaid each rectangular segment corresponds to a brightness average value, this value can be mathematic average or weighted average, and the weighted average value can more accurately represent the brightness information of each segment.

In step 440, several segments are combined according to the analysis method and analysis result obtained from step 430. The aforesaid several brightness values are divided into several grades, the rectangular segments whose brightness average values are in the same range are combined into a segments, therefore several image segments are formed, so the procedure of image division can be finished. The classification of grades using constant brightness value is easy to perform, but for most of image signals, this classification is not the perfect one. Preferably, in order to make the number of each segment in each grade closes to each other; the method of the present invention groups all segments according to the brightness histogram. The advantage of using the brightness histogram to divide is that more levels can be divided for those images whose brightness is more concentrated (such as the whole picture is relatively dark or light).

In step 450, generally the backlight segments are same as the image segments for easy handling.

In step 460, the adjustment for the brightness of the backlights in different backlight segments may by performed in the following steps it includes: calculating the brightness normalized coefficient of each backlight segment; generating the driving signal according to the brightness normalized coefficient. The calculation of the brightness normalized coefficient is illustrated above, and is omitted here. After the brightness normalized coefficient has been calculated, a driving signal is generated for the corresponding backlight segment. The driving signal can be a driving current or driving voltage. Take driving current for example, the strength of the driving current equals to the multiplication of the preliminary current by the brightness normalized coefficient, and the preliminary current represents the maximum working current of the backlight segment. The decrease of the backlight driving current can effectively decrease the power consumption of LCD apparatuses.

Step 470 adjusts the image in each image segment. Since step 460 adjusts the brightness of the backlight segments, in order to properly display the original image, the image signal must be adjusted. Since the brightness of the backlight segment is decreased, the image brightness of the corresponding image segment should increase. Suppose the maximum brightness of an image segment is 50, and the maximum brightness after adjustment is 255, then the brightness range of the image segment changes from the original 0-50 to 0-255, and the contrast of the image signal is largely increased. Therefore, the problem of low contrast and unclear levels of the present LCD in low brightness can be solved. Besides just mathematical operation for the brightness of the corresponding image, there are many methods for adjusting the image signal in the image segment, such as image enhancement algorithm of histogram equalization, which can effectively increases the information amount of image and can perfectly display the image signal.

Figure 5:
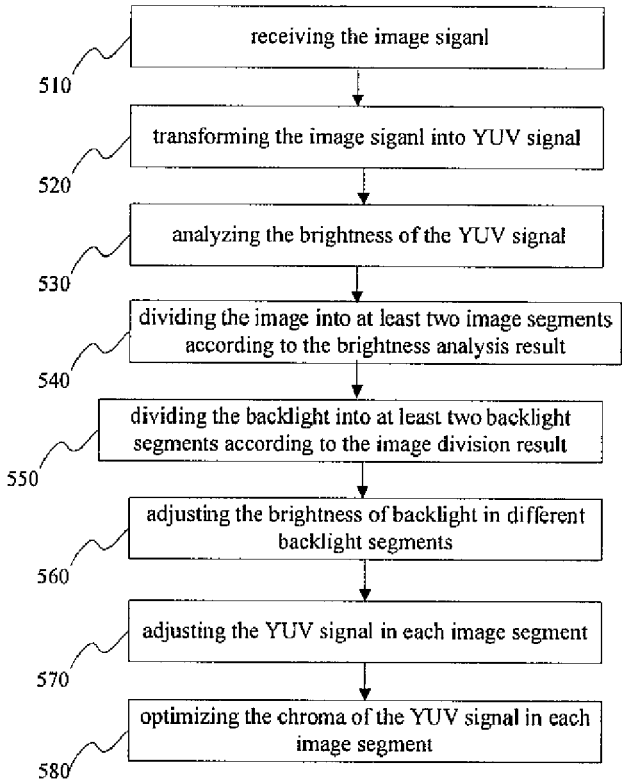
FIG. 5 is a schematic diagram in accordance with the fourth embodiment of the present invention.

As shown in FIG. 5, the schematic diagram of the fourth embodiment of the present invention is the schematic diagram of another LCD method.

It is different from the embodiment shown in FIG. 4 that the embodiment shown in FIG. 5 includes a further step 520 of transforming the image signal to YUV signal.

Please refer to the relative steps in FIG. 4 for steps 530, 540, 550, 560 and 570, the difference between them is that the image signal should be firstly formatively transformed and the transformed YUV signal directly includes the brightness information of the image signal. During the procedure relating to brightness analysis and calculation, the steps in this embodiment are much more easily to be handled than the relative steps in FIG. 2.

There is another difference from the embodiment shown in FIG. 4. Besides the adjustment of the brightness of the image, the embodiment shown in FIG. 5 includes a further step 580 of optimizing the chroma of the YUV signal in each image segment. Step 580 optimizes the chroma signal of the YUV signal. The chroma of the image signal is optimally processed by referring a configurable two-dimensional reference table. Generally, the parameter values in the configurable two-dimensional reference table are experimental values obtained by a lot of subjective evaluating.

Figure 6:
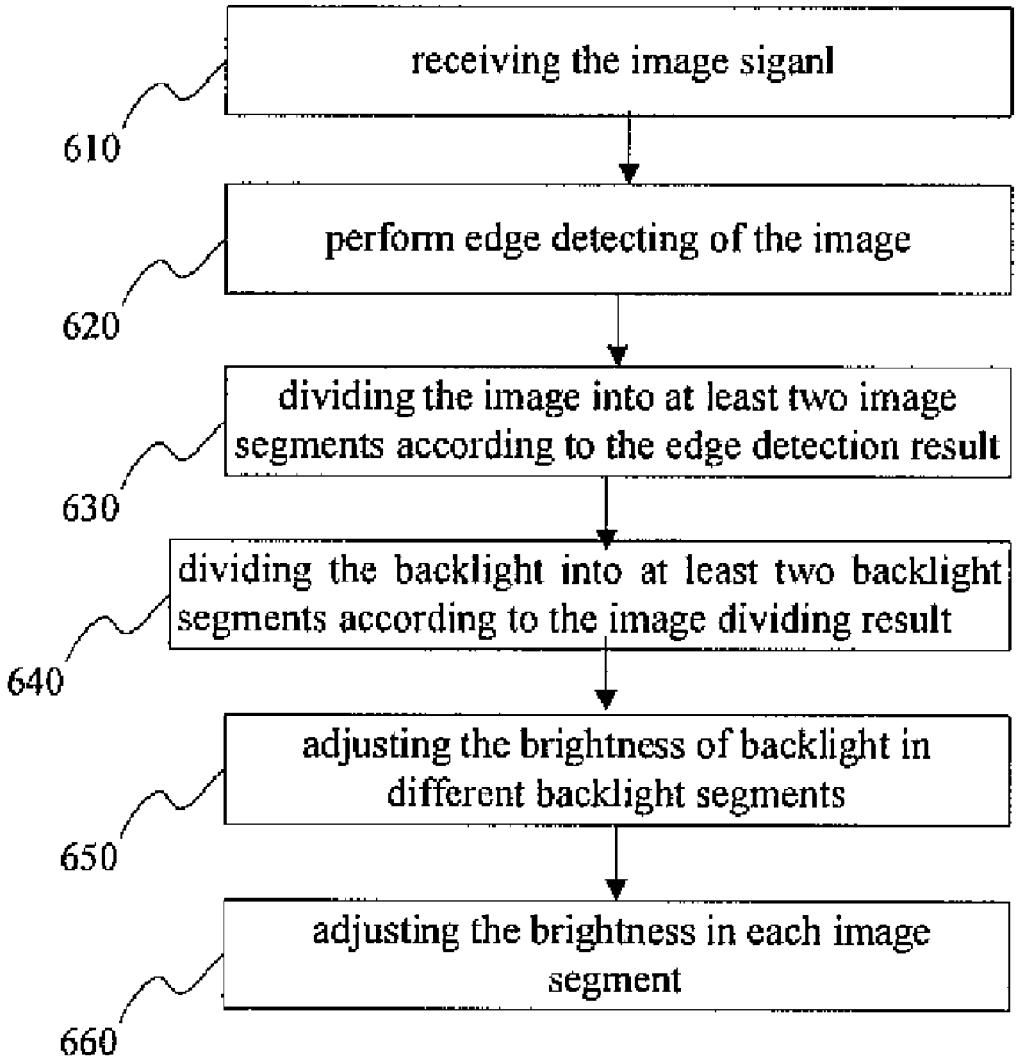
FIG. 6 is a schematic diagram in accordance with the fifth embodiment of the present invention.

As shown in FIG. 6, the schematic diagram of the fifth embodiment of the present invention is the schematic diagram of another LCD method.

The LCD method of this embodiment uses the edge detection method to analyze the image and divides the image according to the edge detection result. Specifically, the LCD method of the present embodiment includes: step 620 to process edge detection of the image signal and step 630 to divide the image into at least two image segments according to the edge detection result.

There are many methods for edge detection of the image, and the typical edge detection is based on the original image, and each pixel of the image detects its gray jump change in a certain scopes. The change rule of the first order or second order directional derivative near the edge is used to detect the edge. Usually edge detection methods includes: difference edge detection, gradient edge detection, Roberts edge detection operator, Sobel edge detection operator, Prewitt edge detection operator and Laplace edge detection operator. Step 620 can be realized by using any one of them. Take difference edge detection for example, the first order derivative operator of the image pixel gray can be used to get the high value where the gray rapidly changes. Its value at a certain point represents the "edge intensity" of that point; threshold can be set for these values to definitely detect the edge element in the image.

Step 630 connects each edge element to form a closed region according to the result of the edge detection, and the region forms a segment of the image. The area of some formed image segments maybe too small, in order to easily handle, step 630 can set a certain rule to combine the image segment including fewer pixels with certain adjacent image segment to form a new image segment.

Following, steps 640, 650 and 660 can be realized with reference to the aforesaid methods.

From the above procedure, we can seen that the image does not need to be divided into several segments in the present embodiment, while the image is divided directly according to the edge detection result of the image, and the implementation of image division is different.

It should be mentioned that the illustration of the LCD method in accordance with the embodiment of the present invention only described the necessary steps, and steps such as removal of noises in the image which is usually applied in regular image process, can also be used in the LCD method in the present invention.

In the above, the LCD method and apparatuses of the present invention has been described with reference to the preferred embodiment, it is evident that various modifications and changes may be made by those skilled in this filed without departing from the spirit and scope of the present invention. Thus, the present invention is intended to embrace all such modifications and changes.

What is claimed is:

1. A liquid crystal display method comprising:

providing a liquid crystal display comprising a backlight;

receiving an image signal;

analyzing the image signal;

dividing the image into at least two image segments according to the analysis result of the image signal;

dividing the backlight into at least two backlight segments according to the division result of the image;

adjusting brightness of each backlight segment; and adjusting the image signal in each image segment, wherein said analyzing the image signal comprises performing edge detecting of the image, and wherein said dividing according to the result of the image signal comprises dividing the image according to the result of the edge detecting.

2. A liquid crystal display method of claim 1, wherein said analyzing the image signal comprises analyzing the brightness of the image signal, and said dividing the image according to the analysis result of the image signal comprises dividing according to the brightness analysis result of the image signal.

3. A liquid crystal display method of claim 2, wherein said analyzing the brightness of the image signal comprises dividing the image into a plurality of segments and calculating the maximum brightness of each segment, and wherein said dividing according to the brightness analysis result of the image signal comprises combining two or more segments among the plurality of segments with comparable maximum brightness into one of said image segments.

4. A liquid crystal display method of claim 3, wherein said dividing the image into the plurality of segments comprises dividing the image into a plurality of rectangular segments with same size.

5. A liquid crystal display method of claim 2, wherein said analyzing the brightness of the image signal comprises dividing the image into a plurality of segments and calculating the average brightness of each segment, and wherein said dividing according to the brightness analysis result of the image signal comprises combining two or more segments among the plurality of segments with comparable average brightness into one of said image segments.

6. A liquid crystal display method of claim 1, wherein said liquid crystal display method further comprises transforming said image signal into YUV signal.

7. A liquid crystal display method of claim 6, wherein said liquid crystal display method further comprises optimizing the chroma of said YUV signal.

8. A liquid crystal display method of claim 6, wherein said adjusting the brightness of each backlight segment comprises calculating the brightness normalized coefficient of each backlight segment, and generating a driving signal corresponding to the brightness normalized coefficient.

9. A liquid crystal display method of claim 1, wherein said adjusting the brightness of each backlight segment comprises calculating the brightness normalized coefficient of each backlight segment, and generating a driving signal corresponding to the brightness normalized coefficient.

10. A liquid crystal display apparatus comprising:

an image input interface configured to receive an image signal;

a liquid crystal display screen;

a backlight; and an image processing device wherein the image processing device comprises:

a CPU;

an image analysis unit configured to perform edge detecting of the image so as to analyze said image signal;

a division unit configured to divide said image signal into at least two image segments according to the result of the edge detecting and divide said backlight into at least two backlight segments according to the image division;

a backlight driver configured to adjust the brightness of each backlight segment; and a liquid crystal interface unit configured to adjust the brightness of said image signal in each image segment and send an adjusted image into said liquid crystal display screen.

11. A liquid crystal display apparatus of claim 10, wherein said CPU is configured to determine the brightness adjustment rule of each backlight segment, and said backlight driver is configured to adjust the brightness of each backlight segment according to said brightness adjustment rule.

12. A liquid crystal display apparatus of claim 11, wherein said CPU is configured to calculate the brightness normalized coefficient of each image segment according to the maximum brightness of each image segment, said backlight driver is configured to generate the driving signal of each backlight segment according to said brightness normalized coefficient, and said liquid crystal interface unit is configured to adjust the image signal brightness in each image segment according to said brightness normalized coefficient.

13. A liquid crystal display apparatus of claim 10, wherein said image analysis unit is configured to analyze the brightness of said image signal, and said division unit is configured to divide said image according to the brightness analysis result of said image analysis unit.

14. A liquid crystal display apparatus of claim 13, wherein said image analysis unit is configured to divide the image into a plurality of segments and calculate the maximum brightness of each of the plurality of segments, and said division unit is configured to combine two or more among the plurality of segments to form one of said image segments according to a division rule.

15. A liquid crystal display apparatus of claim 14, wherein said division rule is determined by image division standards according to the weighted average brightness of the brightness histogram of said image.

16. A liquid crystal display apparatus of claim 10, wherein said image analysis unit is configured to transform said image signal into YUV signal.

17. A liquid crystal display apparatus of claim 16, wherein said liquid crystal interface unit is configured to optimize the chroma of said YUV signal.

* * * * *